US006681951B2

(12) United States Patent
Schlösser

(10) Patent No.: US 6,681,951 B2
(45) Date of Patent: Jan. 27, 2004

(54) CONTAINER FOR KEEPING FILLED BOTTLES COOL

(75) Inventor: Monika Schlösser, Vettelschoss (DE)

(73) Assignee: Schlösser GmbH, Vettelschoss (DE)

( * ) Notice: Subject to any disclaimer, the term of this patent is extended or adjusted under 35 U.S.C. 154(b) by 94 days.

(21) Appl. No.: 10/042,638

(22) Filed: Jan. 9, 2002

(65) Prior Publication Data

US 2003/0010784 A1 Jan. 16, 2003

(30) Foreign Application Priority Data

Jul. 11, 2001 (DE) ..... 201 11 534 U

(51) Int. Cl.[7] ..... B65D 81/00

(52) U.S. Cl. ..... 220/592.27; 220/592.28; 220/23.88

(58) Field of Search ..... 220/592.27, 592.28, 220/23.88, 509

(56) References Cited

U.S. PATENT DOCUMENTS 1,541,799 A * 6/1925 Dodge ..... 220/573.5
2,428,996 A * 10/1947 Schworm, Jr. ..... 219/428
3,069,043 A * 12/1962 Bishop ..... 220/592.28
3,108,840 A * 10/1963 Conrad et al. ..... 312/400
3,182,884 A * 5/1965 Washburn ..... 220/23.88
3,709,235 A * 1/1973 Washburn et al. ..... 132/290
5,451,524 A * 9/1995 Coble et al. ..... 435/284.1
5,769,262 A 6/1998 Yamada et al.
6,026,978 A 2/2000 Clegg et al.

FOREIGN PATENT DOCUMENTS

| | | |
|---|---|---|
| DE | 1912865 | 3/1965 |
| DE | 8512861 | 6/1985 |
| DE | 298 16 828 U1 | 3/2000 |

* cited by examiner

*Primary Examiner*—Joseph Man-Fu Moy
(74) *Attorney, Agent, or Firm*—Friedrich Kueffner

(57) ABSTRACT

A container for keeping filled bottles cool includes an outer cup-shaped component and an inner cup-shaped component placed in the outer cup-shaped component at a distance from the side wall and the bottom of the outer cup-shaped component. The inner cup-shaped component has a hollow projection which protrudes upwardly from its bottom for laterally supporting bottles placed in the inner cup-shaped component between the side wall thereof and the projection. The inner and outer cup-shaped components are covered by a common cover. The cover has holes arranged on a circle for passing filled bottles therethrough. The interior of the projection is filled with gas or is evacuated.

6 Claims, 5 Drawing Sheets

CONTAINER FOR KEEPING FILLED BOTTLES COOL

BACKGROUND OF THE INVENTION

1. Field of the Invention

The present invention relates to a container for keeping filled bottles cool, wherein an inner cup-shaped component is placed in an outer cup-shaped component at a distance from the side wall and the bottom of the outer cup-shaped component, and wherein the inner cup-shaped component has a hollow projection which protrudes upwardly from its bottom for laterally supporting bottles which have been placed in the inner cup-shaped component between the side wall of the inner cup-shaped component and the projection. The inner and outer cup-shaped components are covered by a common cover which has holes arranged on a circle for passing one of the filled bottle components therethrough.

2. Description of the Related Art

A conventional container of the above-described type is used as a table unit. A frozen cooling element is placed in the hollow projection of the inner cup-shaped component, so that beverage bottles placed in the container are cooled and/or are kept cool over longer periods of time. This causes the cooling element to warm up, so that it must once again be frozen or replaced by another already frozen cooling element. Cooling elements and the exchange of cooling elements are cumbersome. They also require that a freezer unit is present. At large conferences, where such cooling containers are frequently used, such freezer units are not available. Moreover, service personnel is required for the use of the freezer units.

SUMMARY OF THE INVENTION

Therefore, it is the primary object of the present invention to provide a container of the above-described type which is less cumbersome and is easier to manipulate.

In accordance with the present invention, the above object is met by a container in which the interior space of the projection is filled with gas or is evacuated.

In many cases in which filled beverage bottles have already been cooled in a refrigerator or the like, such a container is sufficient for keeping the bottles including contents cool until they are emptied, for example, during a conference, because the gas or vacuum in the interior of the projection serves as an insulator. The bottles are then kept cool at least on that side which rests against the projection, wherein the outer contour of the projection is adapted at least partially to the contour of the bottle. Accordingly, a cooling element is not required.

The space between the outer and inner cup-shaped components can also be filled with gas or evacuated. This further improves the insulating effect of the container.

In addition, the circumference of at least some of the holes provided in the cover can be adapted to the circumference of different bottles. While it is possible to provide all of the holes with the same diameter, which is adapted to the diameter of bottles which have a round cross-section, and to place only those bottles into the container whose diameters correspond to that of the holes. However, sometimes it is desirable not only to use bottles having a diameter adapted to the diameter of the holes, but also bottles having smaller diameters. Heat could penetrate into the container through the gap between the edge of the hole and the smaller inserted bottle. If the circumference of at least some of the holes provided in the cover is adapted to the circumference of different bottles it is possible to tightly seal the larger holes with bottles adapted to these larger holes and to essentially tightly seal the smaller holes with bottles adapted in their circumference to the smaller holes, so that heat cannot easily penetrate into the container through the gap between the edge of the larger hole and the circumference of a smaller bottle.

The interior space of the projection may be closed off. Also, the space between the inner and outer cup-shaped components may be tightly closed off. For simplicity's sake, the gas may in all cases be air.

The various features of novelty which characterize the invention are pointed out with particularity in the claims annexed to and forming a part of the disclosure. For a better understanding of the invention, its operating advantages, specific objects attained by its use, reference should be had to the drawing and descriptive matter in which there are illustrated and described preferred embodiments of the invention.

DESCRIPTION OF THE PREFERRED EMBODIMENTS

Figure 1:
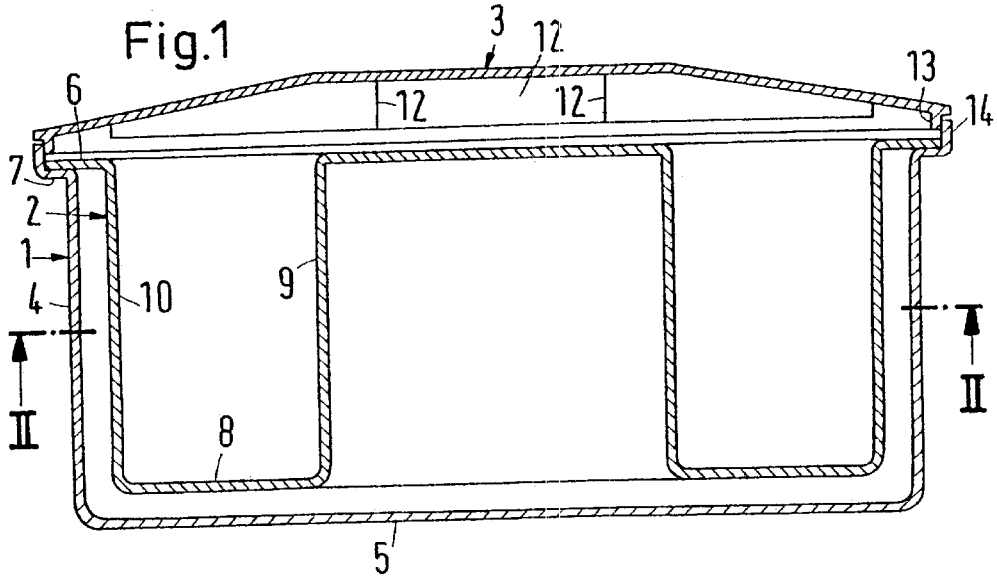
FIG. 1 is an axial sectional view of a container according to the present invention taken along sectional plane I—I of FIG. 2.

The container shown in FIGS. 1–6 of the drawing is composed of an outer cup-shaped component 1, and inner cup-shaped component 2 and a cover 3. All three components are of plastics material.

The inner cup-shaped component 2 is placed in the outer cup-shaped component 1 at a distance from the side wall 4 and the bottom 5 of the outer cup-shaped component 1. The inner cup-shaped component 2 is loosely placed with a radially outwardly protruding flange 6 at its upper rim on an also radially outwardly protruding flange 7 at the upper rim of the outer cup-shaped component 1. However, the flange 6 may also be integrally connected to the flange 7, for example, by welding or gluing.

The inner cup-shaped component 2 has a hollow projection 9 which upwardly projects from its bottom 8. The projection 9 serves to laterally support any beverage bottles or the like, not shown, which are placed in the inner cup-shaped component 2 between the side wall 10 thereof and the projection 9. The outer and inner components 1, 2 are covered by a common cover 3. The cover 3 has holes 11 arranged on a circle for passing therethrough the filled bottle components. The holes 11 each have an axially inwardly projecting cylindrical wall 12. The cover 3 further has a circumferential outer wall 13 which is mounted axially downwardly protruding at the bottom side of the cover 3 and which rests against the inner side of a short circumferential wall 14 of the outer cup-shaped component which protrudes upwardly at the outer circumference of the flange 7.

Figure 2:
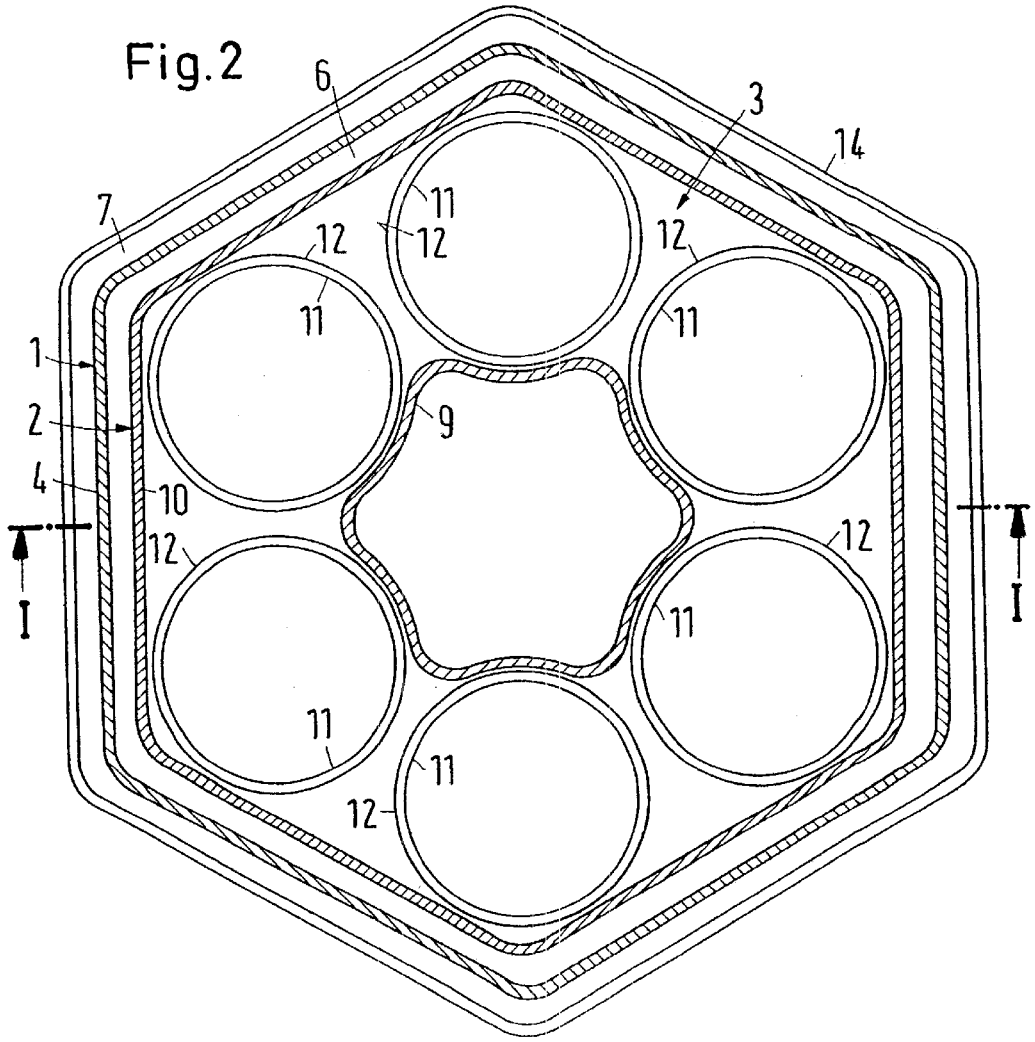
FIG. 2 is a cross-sectional view of the container according to the present invention taken along sectional plane II—II of FIG. 1.
Figure 3:
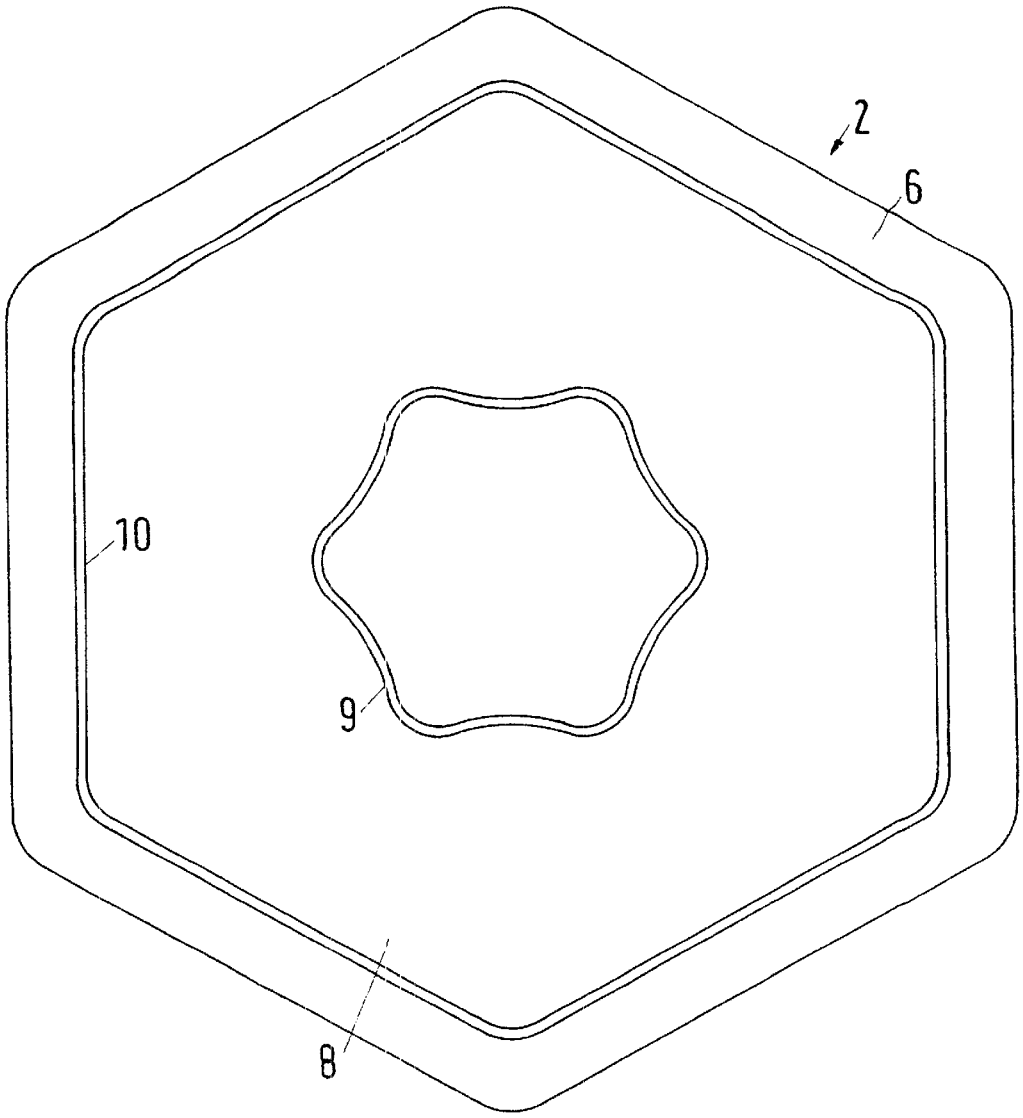
FIG. 3 is a top view of an inner cup-shaped component of the container of FIG. 1.
Figure 4:
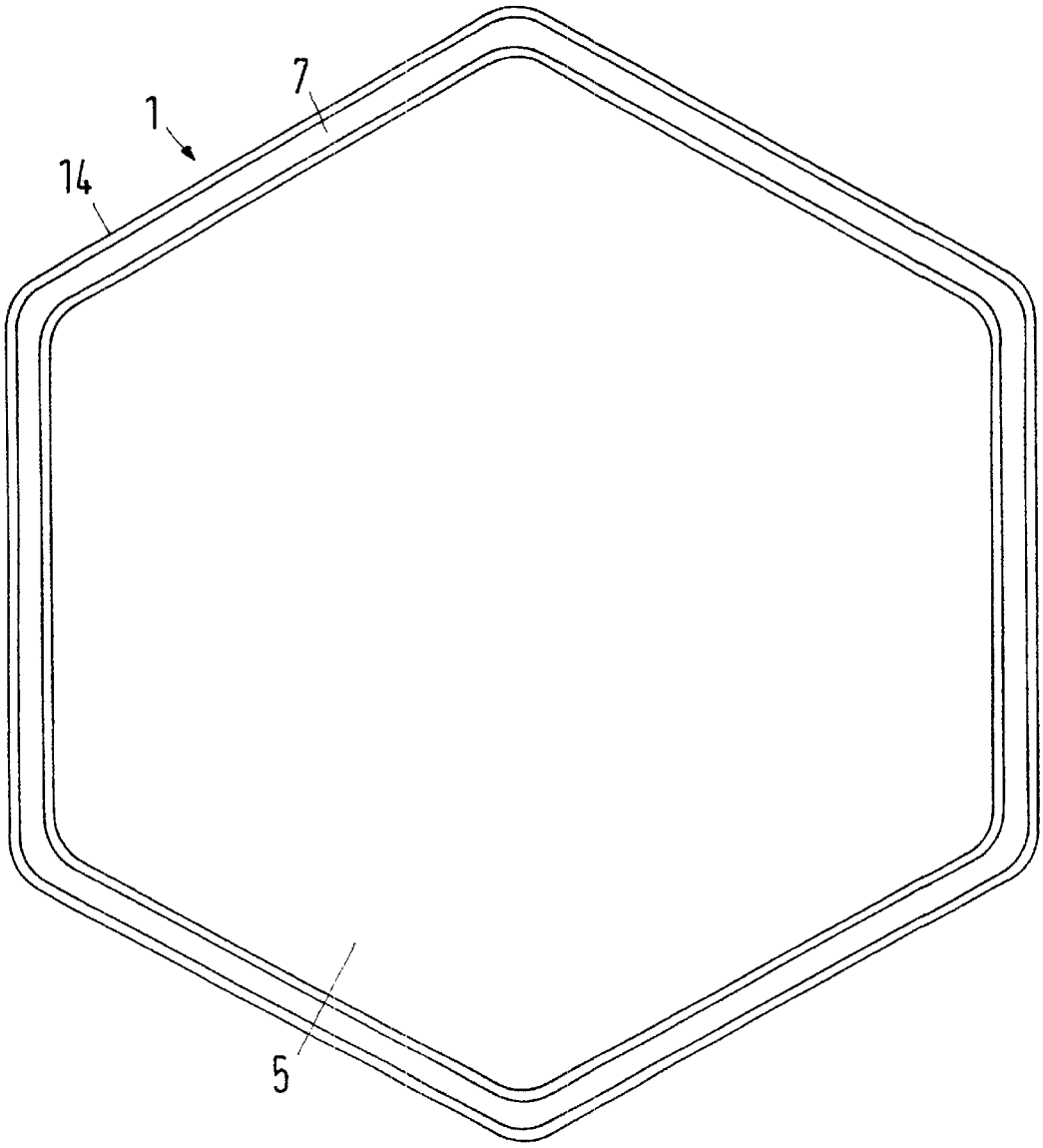
FIG. 4 is a top view of an outer cup-shaped component of the container of FIG. 1.
Figure 6:
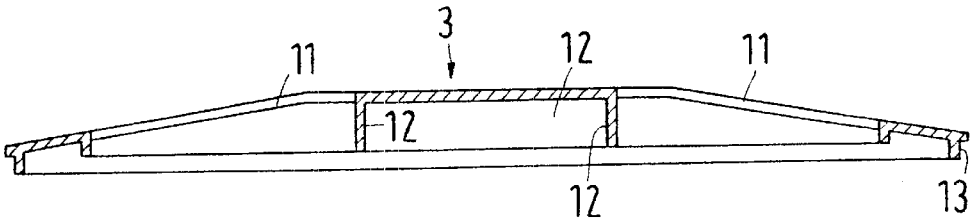
FIG. 6 is a cross-sectional view of the cover of FIG. 1 taken along sectional plane VI—VI of FIG. 5.
Figure 5:
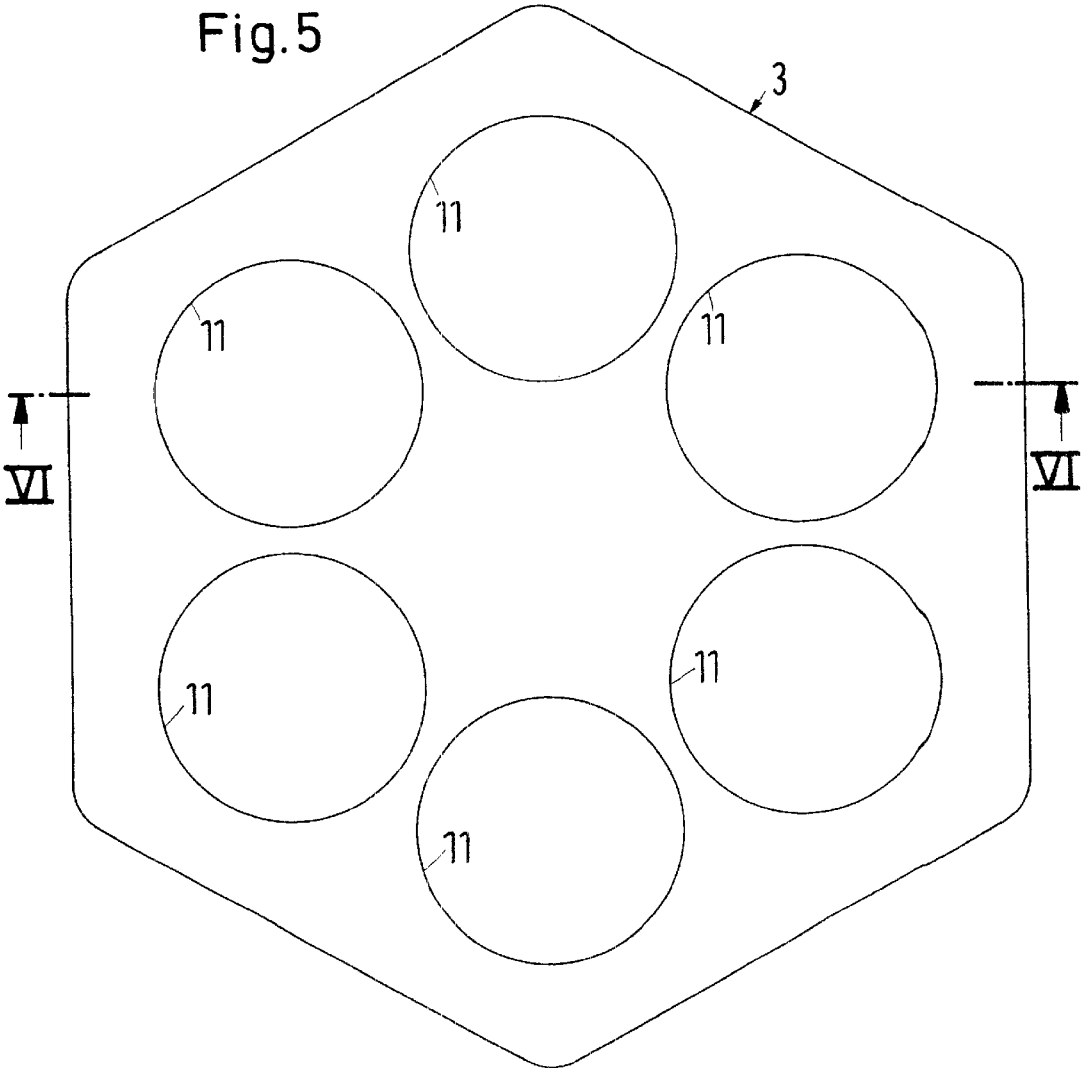
FIG. 5 is a top view of a cover of the container of FIG. 1.

The projection 9 of the inner cup-shaped component 2 has a circumferential contour which partially corresponds to the circumferential contour of round bottles, as illustrated in FIGS. 2 and 3. The bottles are placed in the space between the projection and the side wall 10 in the inner cup-shaped component 2 through the holes 11 whose inner diameters correspond to the outer diameters of the bottles.

The space within the projection 9 and, thus, also the space between the side walls 4 and 10 and between the walls 5 and 8 may be evacuated. The flanges 6 and 7 may then be integrally connected. However, this space may also be filled with gas, wherein the gas simply may be air. If the spaces are filled with air, the flanges 6 and 7 do not have to be connected. The vacuum or the gas in the hollow spaces between the components 1 and 2 serves to thermally insulate the bottles which have been placed through the holes 11 between the walls 9 and 10. If the bottles including contents have been previously cooled, they maintain their temperature over long periods of time, at least for such a period of time until they are normally used up, for example, during a conference. A cooling element, as it is arranged in conventional cooling containers of this type in the hollow space of the projection 9, is now not necessary.

Figure 7:
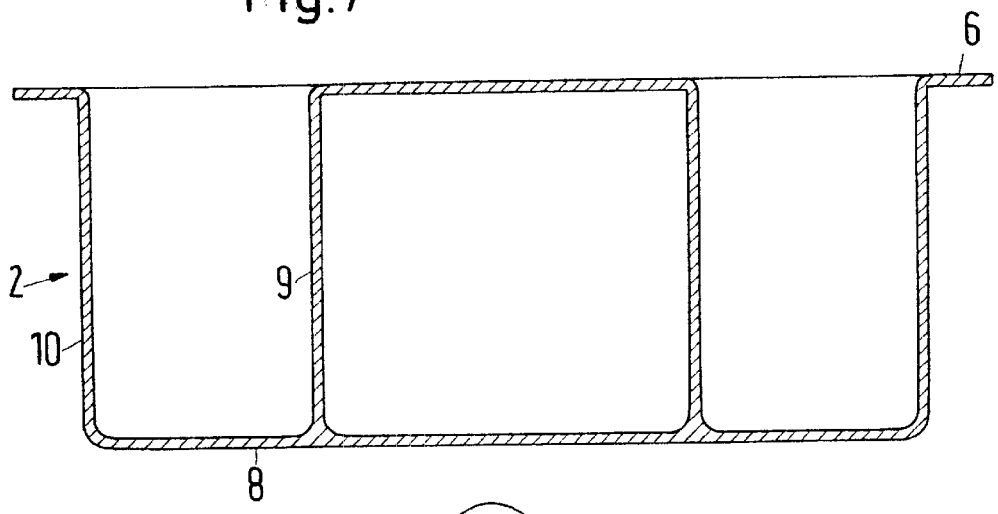
FIG. 7 is an axial sectional view of an inner cup-shaped component which is slightly modified as compared to the inner cup-shaped component of FIG. 1.

FIG. 7 shows a modified embodiment of the inner cup-shaped component 2 in which also the inner space of the projection 9 is closed by a wall 8. The space in the hollow projection 9 is evacuated in this case; alternatively, it may also be filled with gas.

Figure 8:
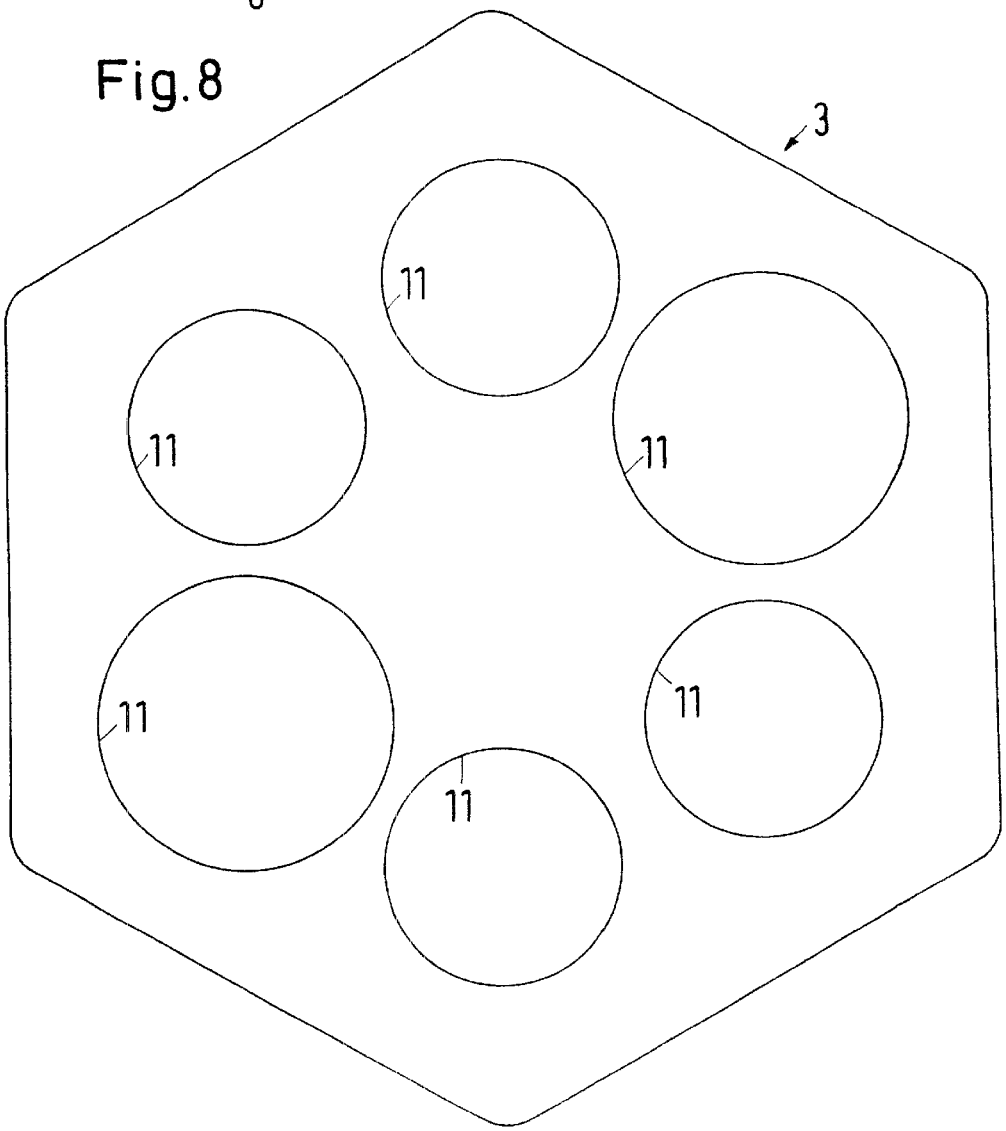
FIG. 8 is a top view of a slightly modified cover of the container.

FIG. 8 shows a modified embodiment of the cover 3 in which four of the six holes 11 have a smaller diameter than the other two holes 11. It is now possible to place bottles having smaller diameters into the holes 11 having the corresponding smaller diameters; in contrast, in the first embodiment described above, the smaller bottles had to be placed in the larger holes, so that a temperature compensation could occur due to convection through the gap between the smaller bottles and the larger holes 11. In the embodiment of the cover according to FIG. 8, such a temperature compensation can be prevented if all holes are filled with bottles having the same diameter.

In both illustrated embodiments, the outer cup-shaped component 1, the inner cup-shaped component 2 and the cover 3 each have a hexagonal shape as seen from the top. This makes it possible to transport several such containers arranged essentially without gaps next to each other. Moreover, the outer cup-shaped component 1 and the inner cup-shaped component 2 each have side walls 4 and 10 which slightly expand upwardly, while the side wall of the projection 9 slightly narrows upwardly. On the one hand, this facilitates ejection of the components 1 and 2 of plastics material from the mold when they are manufactured. On the other hand, several outer components 1 can be placed into each other in a space-saving manner. In the same way several inner components 2 can be stacked in a space-saving manner.

While specific embodiments of the invention have been shown and described in detail to illustrate the inventive principles, it will be understood that the invention may be embodied otherwise without departing from such principles.

I claim:

1. A container for keeping filled bottles cool, the container comprising an outer cup-shaped component and an inner cup-shaped component received in the outer cup-shaped component at a distance from a side wall and a bottom of the outer cup-shaped component, wherein the inner cup-shaped component has a hollow projection protruding upwardly from the bottom thereof, the hollow projection being adapted for laterally supporting bottles placed in the inner cup-shaped component between a side wall thereof and the projection, and a common cover for the inner cup-shaped component and the outer cup-shaped component, the cover having holes arranged on a circle for passing filled bottles therethrough, wherein the projection has an interior which is filled with gas or is evacuated.

2. The container according to claim 1, wherein a space between the outer and inner cup-shaped components is filled with gas or is evacuated.

3. The container according to claim 1, wherein at least some of the holes in the cover have diameters adapted to diameters of bottles.

4. The container according to claim 1, wherein the inner space of the projection is closed off by a wall.

5. The container according to claim 1, wherein the space between the inner and outer components is tightly closed off.

6. The container according to claim 1, wherein the gas is air.

* * * * *